US008310801B2

(12) United States Patent
McDonald et al.

(10) Patent No.: US 8,310,801 B2
(45) **Date of Patent: *Nov. 13, 2012**

(54) FLAME SENSING VOLTAGE DEPENDENT ON APPLICATION

(75) Inventors: Jonathan McDonald, Bloomington, MN (US); Brent Chian, Plymouth, MN (US)

(73) Assignee: Honeywell International, Inc., Morristown, NJ (US)

( * ) Notice: Subject to any disclaimer, the term of this patent is extended or adjusted under 35 U.S.C. 154(b) by 521 days.

This patent is subject to a terminal disclaimer.

(21) Appl. No.: 12/565,676

(22) Filed: Sep. 23, 2009

(65) Prior Publication Data

US 2010/0013644 A1 Jan. 21, 2010

Related U.S. Application Data

(63) Continuation-in-part of application No. 10/908,467, filed on May 12, 2005, now Pat. No. 8,066,508, and a continuation-in-part of application No. 12/368,830, filed on Feb. 10, 2009, which is a continuation-in-part of application No. 11/773,198, filed on Jul. 3, 2007, now Pat. No. 8,085,521.

(51) Int. Cl.
*F23Q 3/00* (2006.01)

(52) U.S. Cl. ..... 361/253

(58) Field of Classification Search ..... 361/253
See application file for complete search history.

(56) References Cited

U.S. PATENT DOCUMENTS

| | | | |
|---|---|---|---|
| 3,425,780 | A | 2/1969 | Potts |
| 3,520,645 | A | 7/1970 | Cotton et al. |
| 3,649,156 | A | 3/1972 | Conner |
| 3,681,001 | A | 8/1972 | Potts |
| 3,836,857 | A | 9/1974 | Ikegami et al. |
| 3,909,816 | A | 9/1975 | Teeters |
| 4,157,506 | A | 6/1979 | Spencer |
| 4,221,557 | A | 9/1980 | Jalics |
| 4,242,079 | A | 12/1980 | Matthews |
| 4,269,589 | A | 5/1981 | Matthews |
| 4,280,184 | A | 7/1981 | Weiner et al. |
| 4,303,385 | A | 12/1981 | Rudich, Jr. et al. |

(Continued)

FOREIGN PATENT DOCUMENTS

| | | |
|---|---|---|
| EP | 0967440 | 12/1999 |

(Continued)

OTHER PUBLICATIONS www.playhookey.com, "Series LC Circuits," 5 pages, printed Jun. 15, 2007.

(Continued)

*Primary Examiner* — Stephen W Jackson

(74) *Attorney, Agent, or Firm* — Seager, Tufte & Wickhem, LLC

(57) ABSTRACT

A system for operating a flame sensing device to obtain readings of increased accuracy without degrading the life of the sensor. There may be levels of a flame requiring a precise measurement. One improvement of accuracy uses higher voltage on the sensor, but this degrades the sensor and thus shortens it life. Further improvement may be achieved by limiting the time that the sensor is operated at a higher voltage. Readings, as if the sensor were operated at a higher voltage, may be inferred from actual readings of the sensor operated at a lower voltage.

20 Claims, 6 Drawing Sheets

U.S. PATENT DOCUMENTS 4,370,557 A 1/1983 Axmark et al.
4,450,499 A 5/1984 Sorelle
4,457,692 A 7/1984 Erdman
4,483,672 A 11/1984 Wallace et al.
4,521,825 A 6/1985 Crawford
4,527,247 A 7/1985 Kaiser et al.
4,555,800 A 11/1985 Nishikawa et al.
4,655,705 A 4/1987 Shute et al.
4,672,324 A 6/1987 van Kampen
4,695,246 A 9/1987 Beilfuss et al.
4,709,155 A 11/1987 Yamaguchi et al.
4,777,607 A 10/1988 Maury et al.
4,830,601 A 5/1989 Dahlander et al.
4,842,510 A 6/1989 Grunden et al.
4,843,084 A 6/1989 Parker et al.
4,872,828 A 10/1989 Mierzwinski
4,904,986 A 2/1990 Pinckaers
4,949,355 A 8/1990 Dyke et al.
4,955,806 A 9/1990 Grunden et al.
5,026,270 A 6/1991 Adams et al.
5,026,272 A 6/1991 Takahashi et al.
5,037,291 A 8/1991 Clark
5,073,769 A 12/1991 Kompelien
5,077,550 A 12/1991 Cormier
5,112,217 A 5/1992 Ripka et al.
5,126,721 A 6/1992 Butcher et al.
5,158,447 A 10/1992 Geary
5,175,439 A 12/1992 Harer et al.
5,222,888 A 6/1993 Jones et al.
5,236,328 A 8/1993 Tate et al.
5,255,179 A 10/1993 Zekan et al.
5,276,630 A 1/1994 Baldwin et al.
5,280,802 A 1/1994 Comuzie, Jr.
5,300,836 A 4/1994 Cha
5,347,982 A 9/1994 Binzer et al.
5,365,223 A 11/1994 Sigafus
5,391,074 A 2/1995 Meeker
5,424,554 A 6/1995 Marran et al.
5,446,677 A 8/1995 Jensen et al.
5,472,336 A 12/1995 Adams et al.
5,506,569 A 4/1996 Rowlette
5,567,143 A 10/1996 Servidio
5,599,180 A 2/1997 Peters et al.
5,682,329 A 10/1997 Seem et al.
5,722,823 A 3/1998 Hodgkiss
5,797,358 A 8/1998 Brandt et al.
5,971,745 A 10/1999 Bassett et al.
6,060,719 A 5/2000 DiTucci et al.
6,071,114 A 6/2000 Cusack et al.
6,084,518 A 7/2000 Jamieson
6,222,719 B1 4/2001 Kadah
6,261,086 B1 7/2001 Fu
6,299,433 B1 10/2001 Gauba et al.
6,346,712 B1 2/2002 Popovic et al.
6,349,156 B1 2/2002 O'Brien et al.
6,356,827 B1 3/2002 Davis et al.
6,385,510 B1 5/2002 Hoog et al.
6,457,692 B1 10/2002 Gohl, Jr.
6,474,979 B1 11/2002 Rippelmeyer
6,486,486 B1 11/2002 Haupenthal
6,509,838 B1 1/2003 Payne et al.
6,552,865 B2 4/2003 Cyrusian
6,676,404 B2 1/2004 Lochschmied
6,743,010 B2 6/2004 Bridgeman et al.
6,782,345 B1 8/2004 Siegel et al.
6,794,771 B2 9/2004 Orloff
6,912,671 B2 6/2005 Christensen et al.
6,917,888 B2 7/2005 Logvinov et al.
7,088,137 B2 8/2006 Behrendt et al.
7,088,253 B2 8/2006 Grow
7,202,794 B2 4/2007 Huseynov et al.
7,241,135 B2 7/2007 Munsterhuis et al.
7,255,285 B2 8/2007 Troost et al.
7,274,973 B2 9/2007 Nichols et al.
7,289,032 B2 10/2007 Seguin et al.
7,327,269 B2 2/2008 Kiarostami
7,617,691 B2 11/2009 Street et al.
7,728,736 B2 6/2010 Leeland et al.
7,764,182 B2 7/2010 Chian et al.
7,768,410 B2 8/2010 Chian
7,800,508 B2 * 9/2010 Chian et al. ..... 340/577
8,066,508 B2 * 11/2011 Nordberg et al. ..... 431/75
8,085,521 B2 * 12/2011 Chian ..... 361/253
2002/0099474 A1 7/2002 Khesin
2003/0064335 A1 4/2003 Canon
2003/0222982 A1 12/2003 Hamdan et al.
2004/0209209 A1 10/2004 Chodacki et al.
2005/0086341 A1 4/2005 Enga et al.
2006/0257805 A1 11/2006 Nordberg et al.
2007/0159978 A1 7/2007 Anglin et al.
2007/0188971 A1 8/2007 Chian et al.
2009/0009344 A1 1/2009 Chian
2009/0136883 A1 5/2009 Chian et al.
2010/0013644 A1 1/2010 Mcdonald et al.
2010/0265075 A1 10/2010 Chian

FOREIGN PATENT DOCUMENTS

EP 1148298 10/2001
WO 9718417 5/1997

OTHER PUBLICATIONS

Honeywell, "SV9410/SV9420; SV9510/SV9520; SV9610/SV9620 SmartValve System Controls," Installation Instructions, 16 pages, 2003.
Honeywell, "S4965 SERIES Combined Valve and Boiler Control Systems," 16 pages, prior to the filing date of present application.
Honeywell, "SV94101SV9420; SV9510/SV9520; SV9610/SV9620 SmartValve System Controls," Installation Instructions, 16 pages, 2003.

* cited by examiner

FLAME SENSING VOLTAGE DEPENDENT ON APPLICATION

The present application is a continuation-in-part of U.S. patent application Ser. No. 10/908,467, filed May 12, 2005, and entitled "Adaptive Spark Ignition and Flame Sensing Signal Generation System". U.S. patent application Ser. No. 10/908,467, filed May 12, 2005, and entitled "Adaptive Spark Ignition and Flame Sensing Signal Generation System", is hereby incorporated by reference.

The present application is a continuation-in-part of U.S. patent application Ser. No. 12/368,830, filed Feb. 10, 2009, and entitled "Low Cost High Speed Spark Voltage and Flame Drive Signal Generator", which in turn is a continuation-in-part of U.S. patent application Ser. No. 11/773,198, filed Jul. 3, 2007, and entitled "Flame Rod Drive Signal Generator and System". U.S. patent application Ser. No. 12/368,830, filed Feb. 10, 2009, and entitled "Low Cost High Speed Spark Voltage and Flame Drive Signal Generator", is hereby incorporated by reference. U.S. patent application Ser. No. 11/773,198, filed Jul. 3, 2007, and entitled "Flame Rod Drive Signal Generator and System", is hereby incorporated by reference.

RELATED APPLICATIONS

The present application is related to the following indicated patent applications: U.S. patent application Ser. No. 11/741,435, filed Apr. 27, 2007, and entitled "Combustion Instability Detection"; U.S. patent application Ser. No. 11/276,129, filed Feb. 15, 2006, and entitled "Circuit Diagnostics from Flame Sensing AC Component"; U.S. patent application Ser. No. 11/306,758, filed Jan. 10, 2006, and entitled "Remote Communications Diagnostics Using Analog Data Analysis"; U.S. patent application Ser. No. 10/908,466, filed May 12, 2005, and entitled "Flame Sensing System"; U.S. patent application Ser. No. 10/908,465, filed May 12, 2005, and entitled "Leakage Detection and Compensation System"; U.S. patent application Ser. No. 10/908,463, filed May 12, 2005, and entitled "Dynamic DC Biasing and Leakage Compensation"; and U.S. patent application Ser. No. 10/698,882, filed Oct. 31, 2003, and entitled "Blocked Flue Detection Methods and Systems"; all of which are incorporated herein by reference.

BACKGROUND

The invention pertains to sensors and particularly to flame sensors. More particularly, the invention pertains to optimization of flame sensing.

SUMMARY

The invention is a system for operating a flame sensing device to obtain readings of increased accuracy without degradation of the life of the sensor.

DESCRIPTION

The flame current sensed in an ignition system may depend on the applied voltage. In particular, the relationship between AC voltage and flame current at a given frequency may be different for each application. Not only does this result in less accurate flame readings, but could create a safety concern if not handled properly. In addition, using too high of an AC voltage may cause excessive build-up of contamination on a flame rod, increased energy consumption that generates extra heat, and also stress associated electronic circuitry unnecessarily.

One possibility for more accurately measuring the flame signal at a given frequency may be to increase the AC voltage when accuracy is critical. It appears that higher voltages reduce the overall differences between different flame rod configurations. Once a flame has been established, the AC voltage may be adjusted to a lower level to avoid excessive component stress, energy consumption, increased electrical noise, and contamination build-up.

Another approach may be to vary the AC voltage in order to generate a curve of flame readings for a particular flame rod configuration. Once this curve or ratio between different voltages has been determined at a given flame level, a lower AC voltage may be used and the flame sensed value can be scaled as needed.

An electronic circuit with adjustable AC voltage supply may be used to generate the different voltage levels. This may be accomplished using a resonant circuit such as an inductor-capacitor combination driven at varying duty cycles with a feedback network used to fine-tune the voltage level. The software in an embedded microprocessor may then adjust the AC voltage to the highest level required, say 250 Vpk, for most accurate flame sensing, and can readjust to a lower level, say 170 Vpk or 90 Vpk, to sense less critical flame levels and help extend the life of the system. Other voltage levels may be used, depending on the particular flame sensing apparatus.

Alternatively, the microprocessor may switch between different voltage levels very quickly and compare the flame readings at each level to determine a ratio factor. Using this ratio factor, the measured flame current at lower voltage levels may be scaled to an equivalent higher voltage reading or via a predetermined lookup table, based on empirical or calculated data, for greater accuracy.

Either method may limit the amount of time using the highest voltage levels, thus reducing component stress and noise, limiting energy consumption, and improving life of the flame rod with reduced contamination build-up.

Figure 1:
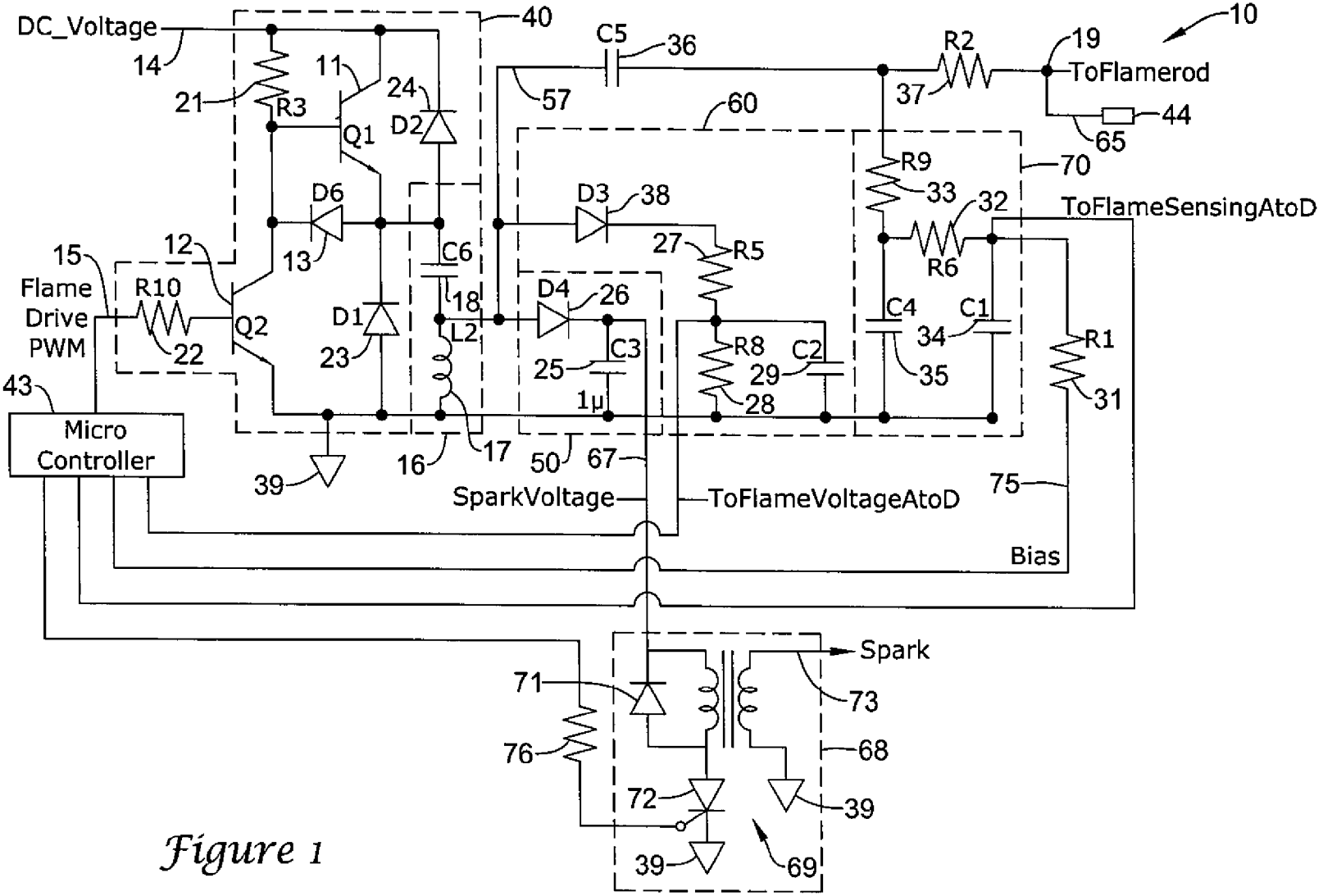
FIG. 1 is a diagram of a spark voltage and flame signal generation circuit.

FIG. 1 is a diagram of a spark and flame signal generation circuit 10. Transistors 11 and 12 and diode 13 form a push-pull drive. DC_voltage 14 relative to a reference terminal or ground 39 may be rectified 24VAC. Voltage 14 may be in the range of 20 to 40 volts. When FlameDrivePWM 15 is at a resonant frequency of the LC circuit 16 containing an inductor 17 and capacitor 18, a high voltage near sinusoidal waveform may be generated as an output 57 at the common node of inductor 17 and capacitor 18. The common node or output of circuit 16 may be also regarded as an output terminal 57. Inductor 17 may have value of about 18 millihenries and capacitor 18 may have a value of about 10 nanofarads. A duty cycle of FlameDrivePWM 15 may be changed with pulse width modulation to control the amplitude of the near sinusoidal waveform. The waveform may be sent to ToFlameRod terminal 19 connected via a D.C. blocking capacitor 36 and current limiting resistor 37. The waveform may proceed from terminal 19 via a line 65 to a flame rod 44 for flame sensing. Capacitor 36 may have a value of about 2,200 picofarads. Resistor 37 may have a value of about 100 K-ohms.

A high level voltage does not necessarily exist anywhere in the drive circuit 40 (a 1.5 K-ohm resistor 21, a 2 K-ohm resistor 22, diode 23, diode 24, diode 13, transistor 11 and transistor 12). So these components may be implemented for low voltage applications and have a low cost.

Diode 23 and diode 24 may be added to provide current path when the resonant current of the LC network 16 is not in perfect synchronization with the drive signal. To generate a spark voltage on capacitor 25 quickly, the drive may need to be rather strong, and diode 23 and diode 24 may be added to improve the network efficiency and reduce the heat generated on the drive components.

A spark voltage circuit 50 may include components 25 and 26. Diode 26 may rectify the AC output voltage from circuit 16 so as to charge up a capacitor 25. Capacitor 25 may be charged up to a high voltage level for spark generation. Typically, capacitor 25 may be 1 microfarad and be charged up to about 170 volts or so for each spark.

An output 67 of circuit 50 may go to a spark circuit 68. Output 67 may be connected to a first end of a primary winding of a transformer 69 and to a cathode of a diode 71. An anode of diode 71 may be connected to a second end of the primary winding. The second end of the primary winding may be connected to an anode of an SCR 72. A cathode of SCR 72 may be connected to a reference voltage or ground 39. A gate of SCR 72 may be connected to controller 43 through a 1 K-ohm resistor 76. A first end of a secondary winding of transformer 69 may be connected to a spark terminal 73. A second end of the secondary winding of transformer 69 may be connected to ground or reference voltage 39.

When capacitor 25 is charged up, a signal from controller 43 may go to the gate of SCR 72 to turn on the SCR and discharge capacitor 25 to ground or reference voltage 39 resulting in a high surge of current through the primary winding of transformer 69 to cause a high voltage to be across the secondary winding to provide a spark between terminal 73 and ground or reference voltage 39.

A diode 38, a 470 K-ohm resistor 27, a 35.7 K-ohm resistor 28 and a 0.1 microfarad capacitor 29 may form a circuit 60 for sensing flame voltage from output 57 of LC circuit 16. Circuit 60 may provide an output signal, from the common connection of resistors 27 and 28 to microcontroller 43, indicating the voltage amplitude of the drive signal to flame rod 44.

A 200 K-ohm resistor 32, a 200 K-ohm resistor 33, a 0.01 microfarad capacitor 34 and a 0.01 microfarad capacitor 35 may form a circuit 70 having an output at the common connection of resistor 32 and capacitor 34 for flame sensing which goes to controller 43. At least a portion of circuit 70 may incorporate a ripple filter for filtering out the AC component of the flame rod drive signal so as to expose the DC offset current of flame rod 44. The DC offset current may be indicated at the output of circuit 70. When a flame is present, flame rod 44 may have a corresponding DC offset current. A resistor connected in series with a diode having its cathode connected to ground may be an equivalent circuit of flame rod 44 sensing a flame. When no flame is present, flame rod 44 may have no or little DC offset current. Resistor 31 may be a bias element. Microcontroller 43 may provide a bias 75 input (e.g., about 4.5 volts) to circuit 70 via a 200 K-ohm resistor 31. As the flame current is flowing from flame rod 44 out to the flame, generating a negative voltage at capacitor 34, a positive bias 75 is necessary to pull the voltage at capacitor 34 above ground or reference voltage 39 for microcontroller 43 to measure the flame.

At first power up, a microcontroller 43 may drive a FlameDrivePWM signal at an input 15 with a nearly square waveform shape. The frequency of the FlameDrivePWM signal at terminal 15 may be varied and the flame voltage at line 57 be monitored to find the resonant frequency of the LC network 16. After that, the drive is generally kept at this frequency, and the duty cycle may be changed so that capacitor 25 can be charged to the required level within the predetermined time interval. This duty cycle may be stored as SparkDuty. The duty cycle may be changed again to find a duty cycle value at which the flame sensing signal is at the desired level, for example, 180 volts peak. This duty cycle value may be saved as FlameDuty. The frequency of the PWM signal 15 may be changed to fine tune the signal amplitude at the output of LC network 16.

One may note that if the DC_Voltage 14 changes, the duties may need adjustment. This adjustment may be done continuously and slowly at run time. At spark time, the FlameDrivePWM signal may stay at the SparkDuty value and the spark voltage be monitored. The SparkDuty value may be adjusted as necessary during spark time.

At flame sensing time, capacitor 25 is to be overcharged some 10 to 20 volts higher than the flame voltage, so that capacitor 25 will not present itself as a burden or heavy load on the LC network 16 and thus the flame voltage at line 57 can be varied quickly.

The flame sensing circuit 70 may support a high flame sensing rate, such as 60 samples per second. Sixty samples/second may be limited by the fact that the drive and flame signal itself carries a line frequency component, not limited by the circuit.

Figure 2:
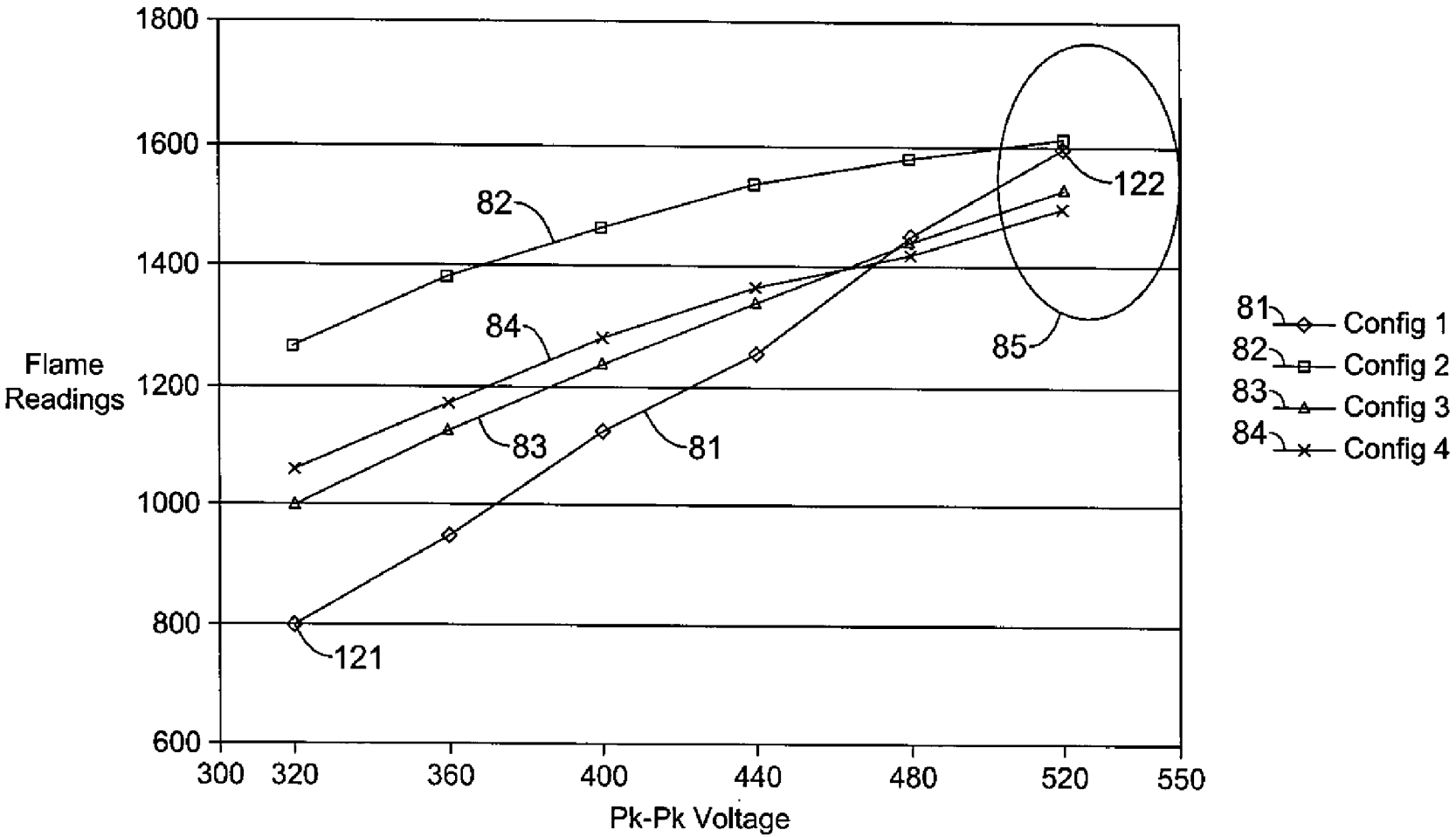
FIG. 2 is a graph showing flame current from four different flame rod configurations over a wide voltage range.

FIG. 2 is a graph showing an example of typical flame readings (taken at one flame level) from four different flame rod configurations over a wide voltage range. Data may be empirically obtained by taking flame readings at various voltages for each of the several configurations, and plotted on a graph like that in FIG. 2 or recorded and arranged in another manner. The flame readings versus peak-to-peak (Pk-Pk) voltage for configurations 1, 2, 3 and 4 are plotted as revealed by curves 81, 82, 83 and 84, respectively. A high voltage flame circuit as described in FIG. 1 may be used to generate the high voltage needed for flame rectification. As the graph shows, expected accuracy at a flame excitation voltage of 320V pk-pk is about +/−20 percent. At 520V pk-pk, the accuracy improves to better than +/−5 percent at area 85. Whenever accuracy of the flame readings is critical, the highest excitation voltage could be used. When flame readings are high and accuracy is less critical, lower excitation voltages may be used to reduce power consumption and noise, extend life of electrical components, and reduce contamination build-up on the flame rod 44.

Figure 3:
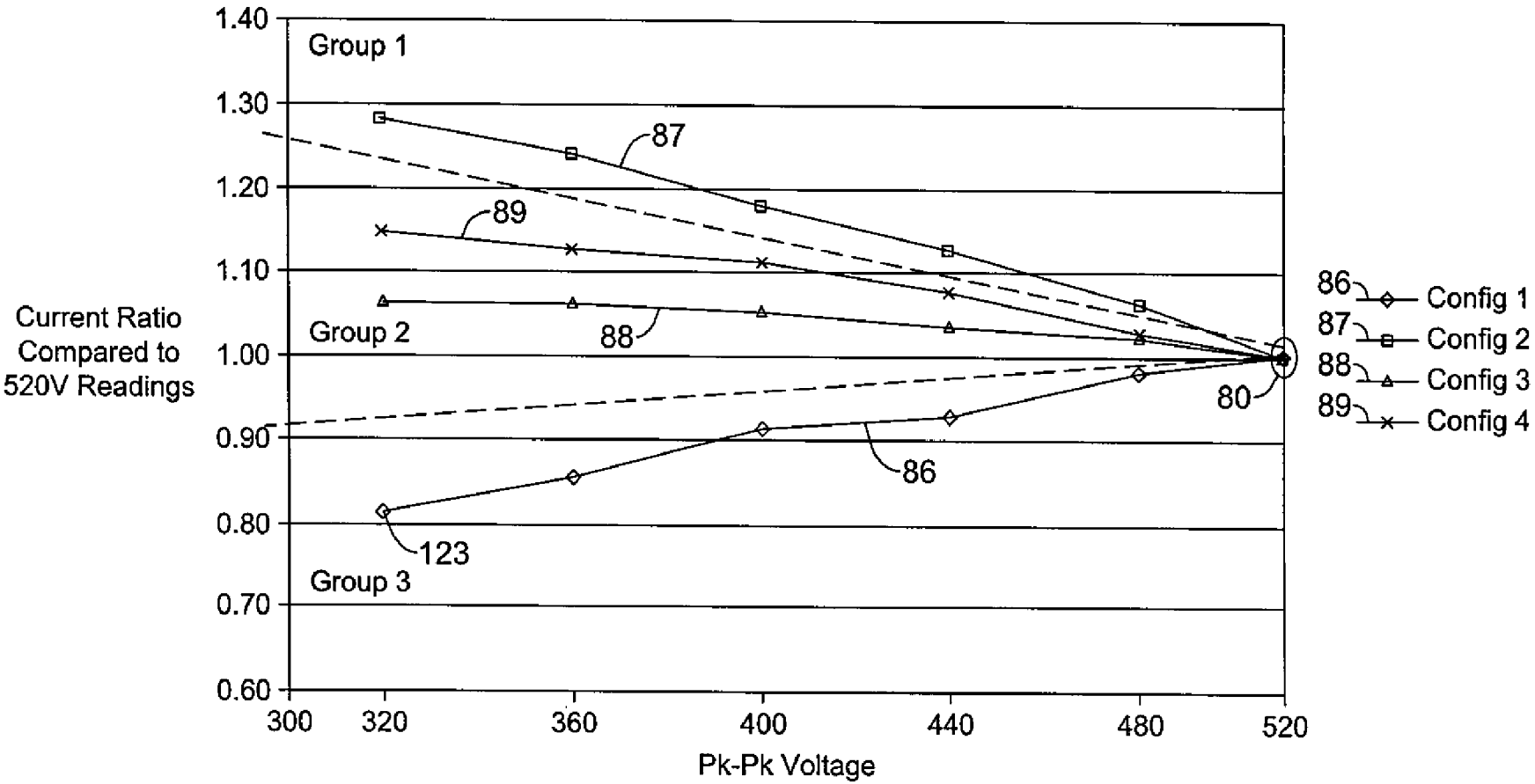
FIG. 3 is a graph showing an approach for improved accuracy of flame sensing without a need for continuous high voltage.

FIG. 3 is a graph showing an approach to gain improved accuracy without the need for continuous flame sensing at a high excitation voltage. The approach includes measuring the flame at a lower voltage and scaling the flame readings to an equivalent higher voltage flame level. A current ratio to 520V readings versus lower Pk-Pk voltages at a given flame level is graphed in FIG. 3 for four different flame rod configurations. To determine which scaling factor to use, a comparison of the flame readings at two different voltages may be done resulting in a "current ratio." For example, in this graph, configuration 1 has a current ratio between 320V pk-pk and 520V pk-pk of just over 0.80, as shown by curve 86, while configuration 2 has a ratio of just less than 1.30, as shown by curve 87. The ratios for configurations 3 and 4 are shown by curves 88 and 89. Data in the graph of FIG. 2 may be used to determine the ratios plotted in the graph of FIG. 3. These current ratios may be used to directly scale a lower voltage flame reading to their equivalent higher voltage levels. Another implementation of this scaling may include dividing the current ratios into predetermined groups 1 through 3, as shown in FIG. 3. Group 2 may include both configurations 3 and 4, represented by curves 88 and 89, respectively, since their current ratios are very close, and as expected in FIG. 2 their actual flame readings are very close. Group 1 may include curve 87 and group 3 may include curve 86. Additional data may be taken and other calculations made for plotting points on the graphs in FIGS. 2 and 3 for different flame rod configurations. Since the ratios in FIG. 3 are based on 520 volts pk-pk readings, the ratios of the configurations converge to one at that level as indicated at area 80. Additional current levels other than those shown in FIGS. 2 and 3 may be used for calculating the flame scaling ratios. These measurements can be referenced by any equivalent voltage units as appropriate, such as pk-pk, pk or rms. Since the ratios shown are for one particular flame level, additional ratios may be calculated to cover the entire operating range of flame currents for greatest accuracy.

The approach for using low voltages to obtain high voltage-like readings may require an initial calibration period when the voltage levels are quickly changed between high and low levels; but once the respective current ratio is established, control may be allowed to run at a low excitation voltage and result in reduced stress on components as noted herein.

A formula may be used for various calculations related to flame sensing. $R_{H1}$ may be regarded as a relatively accurate flame reading of a flame sensor, for example, configuration 1 at a designated high voltage. $V_H$ may represent the designated high voltage for the sensor at a flame reading in the area 85 of FIG. 2, which may be regarded as a relatively accurate area of flame readings from flame sensors of various configurations. $R_{L1}$ may be a flame reading of a flame sensor of the configuration 1 taken at a sensor voltage $V_L$ which would have a magnitude less than that of $V_H$. A flame reading divided by the sensor voltage may be a ratio. For example, $r_{L1}$ may represent the ratio for $R_{L1}/V_L$ and $r_{H1}$ may represent the ratio for $R_{H1}/V_H$ involving a flame sensor of configuration 1. A current ratio relative to the $V_H$ flame reading for configuration 1 may be designated as $r_{C1}$ which may equal $r_{L1}/r_{H1}$ or $(R_{L1}/V_L)/(R_{H1}/V_H)$.

For instance, to calculate the reading-to-voltage ratio ($r_{L1}$) for configuration 1 at a reading for a pk-pk voltage of 320 ($V_L$), one may note a flame reading of 800 units ($R_{L1}$), as shown by point 121 on curve 81 in FIG. 2. A reading-to-voltage ratio ($r_{H1}$), and for a pk-pk voltage of 520 ($V_H$), one may note a reading of about 1600 units ($R_{H1}$) at point 122 on curve 81. One may divide 800 units by 320 volts to obtain 2.50 units per volt ($r_{L1}$), and divide 1600 units by 520 volts to obtain about 3.08 units per volt ($r_{H1}$). To obtain the current ratio for the readings of configuration 1 at 320 volts and 520 volts, one may divide the 2.50 flame reading units per volt at the 320 volt reading by the 3.08 flame reading units per volt at the 520 volt reading to obtain a current ratio of about 0.8125 ($r_{C1}$). This ratio may be plotted as point 123 as part of plot or curve 86 for configuration 1 on the graph in FIG. 3. The flame reading at 520 volts may be regarded as the most precise reading (e.g., a touchstone) since the readings of all the configurations may converge at area 85. With the current ratio ($r_{C1}$) for a flame reading from a flame sensor of configuration 1 at a low 320 volt level, one may calculate, scale or extrapolate a relatively precise flame reading at a high 520 volt level. One may take the $r_{C1}$ equation and derive $R_{H1}=(R_{L1}V_H)/(r_{C1}V_L)$. If a low voltage reading ($V_L$) is 800; calculating for the reading $R_{H1}$ as it should be with the high sensor voltage $V_H$, one may get $(800\times520)/0.8125\times320)=1600$. One may convert other readings at the low voltage for obtaining readings as they would be if obtained at the high voltage. The present approach may be used for obtaining readings for other configurations and voltages. This portion of the approach may be in a look-up table, program, or other form of control. The general approach may be in a look-up table, program, input, or other form of stored control or processing. An advantage of the approach is that without actually running a flame rod and associated components at the high voltage, one may still obtain high-voltage precision readings and avoid excessive component stress, energy consumption and contamination build-up which would occur when obtaining flame readings using high voltage on the flame sensor.

Similar calculations for current ratios may be done for other flame readings at other voltages for the flame sensor or sensing rod 44 (FIG. 1) of configuration 1. Flame readings may be taken for configurations 2, 3 and 4 as shown in the graph of FIG. 2. Calculations may be performed to obtain current ratios for flame sensor or sensing rod configurations 2, 3 and 4, and be plotted as shown in the graph of FIG. 3. Data and calculations may be obtained and plotted for other configurations. The voltages used may also be different. In summary, the information of FIGS. 2 and 3 may be used for obtaining flame readings measured at lower voltages which are nearly as accurate as if these readings were measured at optimally higher voltages. FIGS. 2 and 3 were plotted for one flame level (i.e., 0.7 micro amp). At other flame current levels, the curves may be different. Thus, FIGS. 2 and 3 may be plotted for other flame levels.

Figure 4:
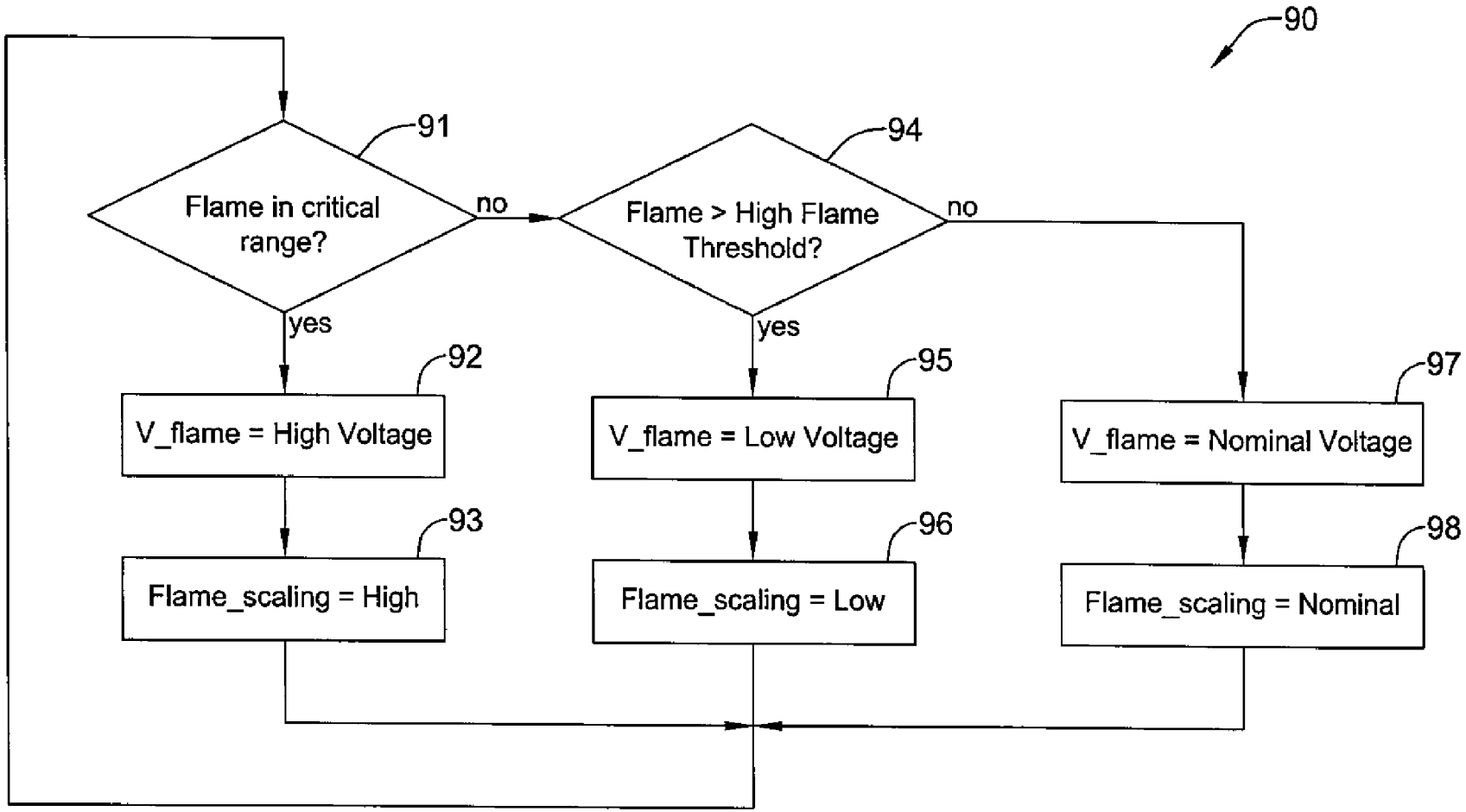
FIG. 4 is a flow diagram of a control system for flame sensing.

FIG. 4 is a diagram 90 of control system of a high level example of the operational flow for an approach of changing between three flame excitation voltage levels—high, nominal, and low. The control may typically operate at the nominal voltage level unless the flame drops below a critical threshold, at which time the excitation voltage may adjust to a higher level for greatest accuracy as shown in FIG. 2. On the other hand, if the flame increases to a higher, less critical level, the excitation voltage may adjust down to a lower level and reduce stress on components. Nominal may be regarded as between low and high.

Flow diagram 90 in FIG. 4 of a control system which may be run by controller 43 of FIG. 1 may begin with a symbol 91 which asks whether the flame is in a critical range. If the answer is yes, then the flame voltage is a high voltage at block 92, which means the flame scaling is high as indicated in block 93. Then the system may return to symbol 91 to inquire again whether the flame is in the critical range. If the answer is no, then the system may go to symbol 94 which asks whether the flame is greater than the high flame threshold. If the answer is yes, then the flame voltage is equal to a low voltage as indicated by block 95, which means that the flame scaling is low as indicated in block 96. Then the system may return to symbol 91 to inquire again whether the flame is in the critical range. If the answer is no, then the system may go to symbol 94 which asks whether the flame is greater than the high flame threshold. If the answer is no, then the flame voltage is equal to the nominal voltage as indicated by block 97, which means that the flame scaling is nominal as indicated in block 98. The system may return to symbol 91 and repeat the inquiries and indications about the flame, voltage and scaling.

Figure 5:
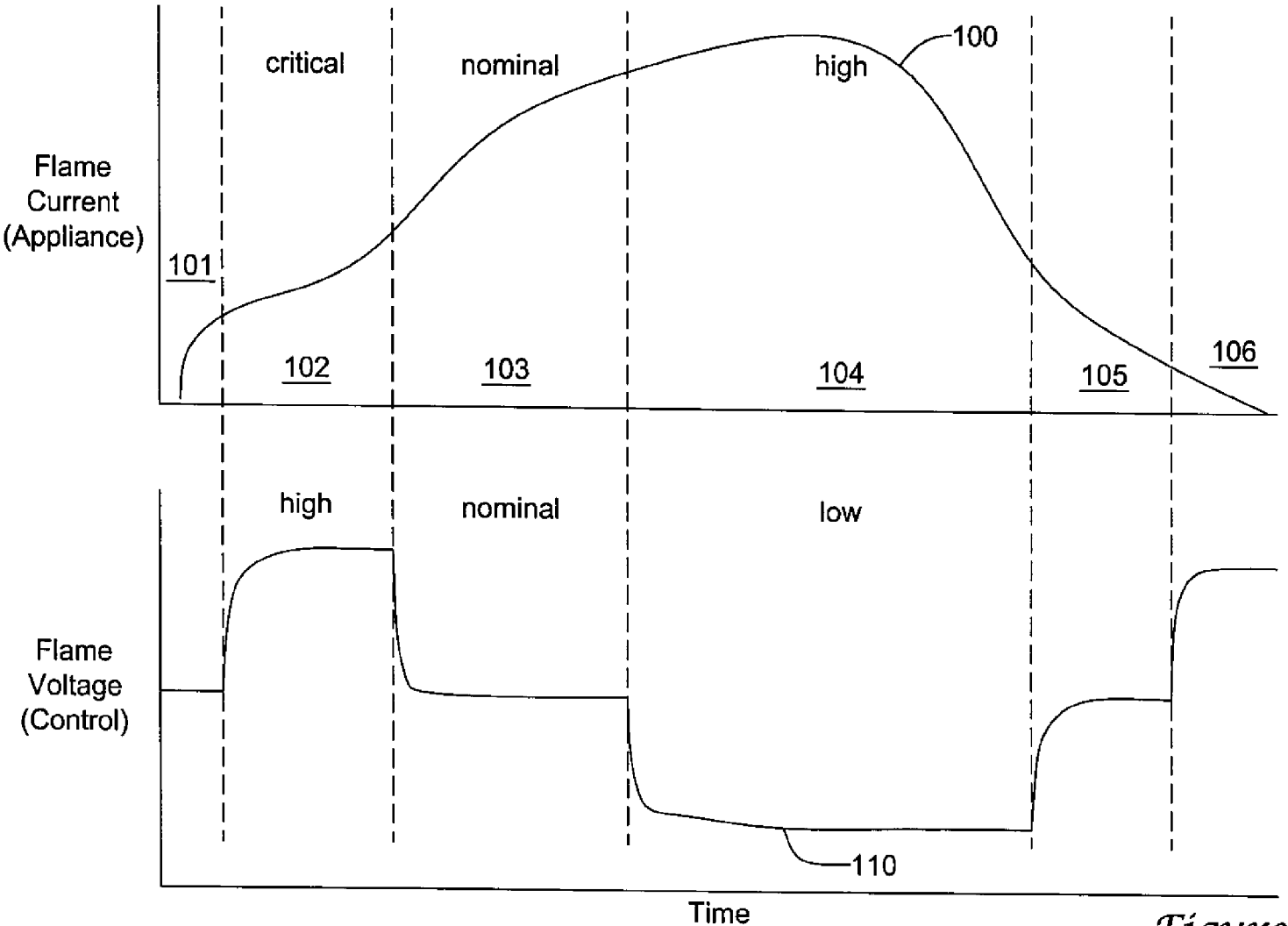
FIG. 5 is a graphic example of the voltage adjustment of the control system described in FIG. 4 based on a typical appliance run cycle.

FIG. 5 is a diagram of a graphic example of the voltage adjustment of the control system described in diagram 90 of FIG. 4 based on a typical appliance run cycle. The top curve 100 shows the flame current of an appliance as it slowly increases at first through the beginning zone 101, the critical zone 102 and nominal zone 103, stabilizes at a high zone 104 level, and then drops off during zones 105 and 106 at the end of the cycle. The control flame voltage is shown on the bottom curve 110 and may be adjusted depending on whether the flame is in the critical, nominal, or high zone or range 102, 103 or 104, respectively.

Figure 6:
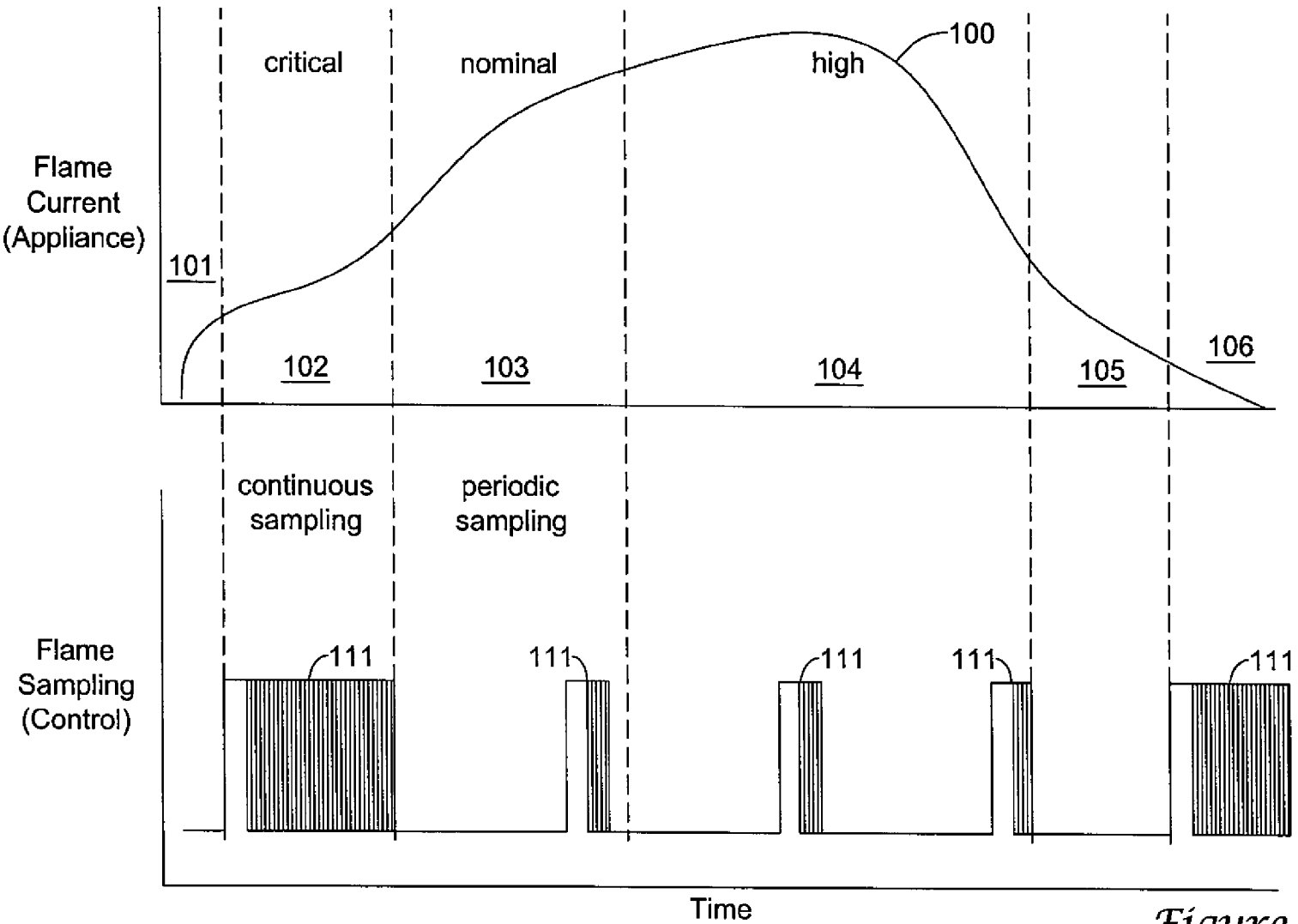
FIG. 6 is a graphic example of the control sampling of the flame signal at various times or zones during an appliance run cycle.

FIG. 6 is a diagram of a graphic example of the control sampling 111 of the flame signal at various times, durations or zones 101, 102, 103, 104, 105 and 106, during a typical appliance run cycle. Since the flame signal may be inherently unstable, especially in appliances that have a lot of air movement, it is important to take enough samples to accurately sense the flame. During generally normal running conditions such as in zones 103, 104 and 105, the flame just needs to be sampled periodically 111 to maintain normal operation, for example only 20 percent or some of the time, thus reducing stress on the flame components. If the flame has reached a critical level in zone 102 or 106, the flame sampling 111 may become continuous to ensure the flame is sensed accurately and quickly.

In the present specification, some of the matter may be of a hypothetical or prophetic nature although stated in another manner or tense.

Although the present system has been described with respect to at least one illustrative example, many variations and modifications will become apparent to those skilled in the art upon reading the specification. It is therefore the intention that the appended claims be interpreted as broadly as possible in view of the prior art to include all such variations and modifications.

What is claimed is:

1. A system for optimal flame sensing, comprising:

a flame sensor;

a variable voltage supply connected to the flame sensor; and a processor connected to the flame sensor and the variable voltage supply; and wherein:

the flame sensor measures a flame with greater precision with increased voltage applied to the flame sensor; and the processor determines whether a flame measurement requires greater precision with an increase of voltage provided by the variable voltage supply to the flame sensor.

2. The system of claim 1, wherein readings of flame sensors of different configurations tend to converge to a same indication as the voltage applied to the sensors increases.

3. The system of claim 1, wherein the processor proceeds through the steps comprising:

determining whether a flame, if sensed, requires more precise measurement;

if the flame does not require more precise measurement and the flame is not greater than a designated high flame threshold, then the voltage supply changes the voltage applied to the flame sensor toward, to or less than a nominal level;

if the flame requires more precise measurement, then the voltage supply changes the voltage applied to the flame sensor to a higher than nominal level; and if the flame does not require more precise measurement and the flame is greater than the designated high flame threshold, then the voltage supply changes the voltage applied to the flame sensor to a lower than nominal level; and wherein the processor designates the high flame threshold and the nominal level at least in part in accordance with properties of the flame.

4. The system of claim 1, wherein a flame scaling is determined in accordance with a relationship relative to the voltage applied to the flame sensor.

5. The system of claim 1, wherein:

data from flame sensor readings at or below a nominal voltage level and a formula provide a basis for calculating equivalent values of the flame sensor as if it were at a voltage higher than the nominal voltage level; and the processor designates the nominal voltage level at least in pa; by properties of the flame.

6. The system of claim 1, wherein flame level readings from the flame sensor are from sampled readings for continuous periods of time when more precise measurements are needed, and from sampled readings for shorter, periodic times when more precise measurements are not needed, as determined by the processor.

7. A method for optimal flame sensing, comprising:

taking a first flame reading of a flame at a given level with a flame sensor at a first voltage; and taking a second flame reading of the flame at the given level with the flame sensor at a second voltage; and wherein:

the second voltage is greater than the first voltage; and accuracy of a flame reading is a function of a voltage connected to the flame sensor, the greater the voltage within a certain range, the more accurate is the flame reading.

8. The method of claim 7, further comprising:

dividing the first flame reading by the first voltage to obtain a first ratio;

dividing the second flame reading by the second voltage to get a second ratio;

dividing the first ratio by the second ratio to obtain a third ratio; and arranging a relationship for determining a second flame reading from the first flame reading, first voltage, second voltage and third ratio.

9. The method of claim 7, wherein:

$$r=(R_1/V_1)/(R_2/V_2)$$

$R_1$ is the first flame reading;

$R_2$ is the second flame reading;

$V_1$ is the first voltage;

$V_2$ is the second voltage;

$V_2>V_1$; and $R_{2Scaled}=R_2/r$.

10. The method of claim 9, further comprising calculating $R_2$ from one or more other $R_1$ readings of the flame at one or more other levels and/or one or more other voltages at the flame sensor, respectively.

11. A system for providing flame sensing, comprising:

a flame sensing device for providing measurements of a flame; and a processor connected to the flame sensing device for receiving measurements of the flame and for controlling voltage at the flame sensing device; and wherein:

an amount of time that a voltage higher than a nominal voltage is applied to the flame sensing device is minimized; and the processor determines the nominal voltage at least in part from properties of the flame.

12. The system of claim 11, further comprising a variable voltage supply, connected to the processor and the flame sensing device, for providing a voltage to the flame sensing device.

13. The system of claim 12, wherein an increase of voltage to the flame sensing device improves accuracy of measurements of a flame.

14. The system of claim 12, wherein if accuracy of a flame measurement needs to be increased, then the voltage applied to the flame sensing device is increased.

15. The system of claim 14, wherein a need for accuracy of a flame measurement increases when the flame decreases.

16. The system of claim 12, further comprising:

a program executable by the processor; and wherein the program comprises data and a formula for calculating a measurement of the flame as if a voltage greater than the nominal voltage were applied to the flame sensing device, from a measurement of the flame of the flame sensing device at a voltage equal to or less than the nominal voltage.

17. The system of claim 16, wherein:

the data and formula comprise:

a first new measurement of a flame at a first voltage; and a second new measurement of the flame at a second voltage;

$$r=(M_1/V_1)/(M_2/V_2)$$

$V_1$ is the first voltage;

$V_2$ is the second voltage;

$M_1$ is the first new measurement;

$M_2$ is the second new measurement; and $M_{2scaled}=M_2/r$.

18. The system of claim 11, wherein:

the samples of flame current are continuous when accuracy of measurements of a flame is to be higher than a nominal accuracy;

the samples of flame current are periodic when the accuracy of measurements of a flame is to be equal to or less than the nominal accuracy; and the nominal accuracy is determined by the processor at least in part according to properties of the flame as sensed by the flame sensing device.

19. The system of claim 18, wherein periodic means that the total samples taken when the flame is present at the flame sensing device is less than the maximum number of samples the processor can handle.

20. The system of claim 18, wherein periodic means that samples are taken at less than 50 percent of a period of time when the flame is present at the flame sensing device.

* * * * *